US010190843B2

(12) United States Patent
Chong

(10) Patent No.: US 10,190,843 B2
(45) Date of Patent: Jan. 29, 2019

(54) PROJECTILE MAGAZINE AND SIMULATED WEAPON HAVING SAME

(71) Applicant: Carlton le Loong Chong, Toronto (CA)

(72) Inventor: Carlton le Loong Chong, Toronto (CA)

( * ) Notice: Subject to any disclaimer, the term of this patent is extended or adjusted under 35 U.S.C. 154(b) by 0 days.

(21) Appl. No.: 15/556,114

(22) PCT Filed: Mar. 7, 2016

(86) PCT No.: PCT/IB2016/051283
§ 371 (c)(1),
(2) Date: Sep. 6, 2017

(87) PCT Pub. No.: WO2016/142842
PCT Pub. Date: Sep. 15, 2016

(65) Prior Publication Data

US 2018/0045482 A1 Feb. 15, 2018

Related U.S. Application Data

(60) Provisional application No. 62/129,209, filed on Mar. 6, 2015.

(51) Int. Cl.
*F41B 11/55* (2013.01)
*F41B 11/51* (2013.01)
(Continued)

(52) U.S. Cl.
CPC ..... *F41B 11/51* (2013.01); *F41B 11/55* (2013.01); *F41B 11/62* (2013.01); *F42B 8/02* (2013.01); *F42B 8/26* (2013.01)

(58) Field of Classification Search
CPC ..... F41B 11/51; F41B 11/62; F41B 11/55; F42B 8/26; F42B 8/02
See application file for complete search history.

(56) References Cited

U.S. PATENT DOCUMENTS 2,601,555 A 6/1952 Pope
2,762,357 A 11/1956 Foster
(Continued)

FOREIGN PATENT DOCUMENTS

CA 2639564 A1 3/2010
CN 2881515 * 3/2007 ..... F41B 11/51
CN 2881515 Y 3/2007

OTHER PUBLICATIONS

International Search Report dated Jul. 5, 2016 for International Application No. PCT/IB2016/051283.
(Continued)

*Primary Examiner* — Michael Dennis
(74) *Attorney, Agent, or Firm* — Perry + Currier Inc.

(57) ABSTRACT

A magazine for projectiles in a simulated weapon includes a housing defining an internal chamber. A gas inlet is situated at an inlet portion of the internal chamber. An outlet situated at an outlet portion of the internal chamber. The internal chamber of the housing is shaped to accommodate a series of spherical projectiles. A restraining element is positioned at the outlet portion of the internal chamber. The restraining element restrains a lead projectile of the series of projectiles against pressure from pressurized gas applied to the gas inlet. The restraining element releases the lead projectile as pressure within the internal chamber rises. The magazine can be integrated in a simulated grenade, simulated shotgun shell, and similar devices.

19 Claims, 7 Drawing Sheets

(51) Int. Cl.

| | |
|---|---|
| ***F42B 8/26*** | (2006.01) |
| ***F42B 8/02*** | (2006.01) |
| ***F41B 11/62*** | (2013.01) |

(56) References Cited

U.S. PATENT DOCUMENTS

| | | | | |
|---|---|---|---|---|
| 3,236,521 | A | 2/1966 | Knott | |
| 3,765,396 | A * | 10/1973 | Kienholz | F41B 11/50 124/44.7 |
| 6,470,872 | B1 | 10/2002 | Tiberius et al. | |
| 2007/0186761 | A1 | 8/2007 | Perry | |
| 2010/0154764 | A1 | 6/2010 | Liao | |
| 2010/0199960 | A1 * | 8/2010 | Chong | F41B 11/62 124/57 |

OTHER PUBLICATIONS

International Preliminary Report on Patentability dated Sep. 12, 2017, by ISA, re PCT International Patent Application No. PCT/IB2016/051283.

* cited by examiner

PROJECTILE MAGAZINE AND SIMULATED WEAPON HAVING SAME

CROSS-REFERENCE TO RELATED APPLICATIONS

This application claims priority to U.S. 62/129,209, filed Mar. 6, 2015, which is incorporated herein by reference.

FIELD

This disclosure relates to simulated weapons that eject projectiles.

BACKGROUND

Devices which fire multiple projectiles, such as pellets, in a short firing cycle have been attempted with poor result.

Most of these attempts involve loading multiple projectiles into a single barrel to be propelled by a single expulsion of compressed gas. For these projectiles to be launched with considerable velocity, very high gas pressure is required to impart enough force to be shared between projectiles. The more pellets are loaded into a single barrel, the more pressure is required to "share" between the total charge of pellets. This leads to the requirement of inconvenient propellant pressures and poor ballistic performance (high spread) with so many projectiles sharing a barrel. Furthermore, high pressure devices may impart very high muzzle energy to single projectiles, or short charges of projectiles, if loading mechanisms malfunction or are intentionally short loaded.

Some attempts to solve these problems involve the firing of multiple barrels loaded with one or more projectiles per barrel. Again the problem of many projectiles per barrel (greater than two projectiles per barrel) becomes apparent with multiple barreled devices. It is impractical to have very many barrels to achieve a high number of high velocity projectiles per firing cycle. Loading is complicated and gas pressure distribution becomes complicated.

SUMMARY OF THE INVENTION

According to one aspect of the present invention, a magazine for projectiles in a simulated weapon includes a housing defining an internal chamber. The housing further includes a gas inlet situated at an inlet portion of the internal chamber and an outlet situated at an outlet portion of the internal chamber. The internal chamber of the housing is shaped to accommodate a series of spherical projectiles. The magazine further includes a restraining element positioned at the outlet portion of the internal chamber. The restraining element is configured to restrain a lead projectile of the series of projectiles against pressure from pressurized gas applied to the gas inlet. The restraining element is configured to release the lead projectile as pressure within the internal chamber rises.

The restraining element can include a convergence of the internal chamber at the outlet portion.

The convergence can have an angle of convergence of less than about half of a pellet angle.

The restraining element can include a detent positioned at the outlet portion of the internal chamber.

The detent can include a ring that has an unstrained internal dimension that less than an outside diameter of the projectile.

The detent can be spring-loaded.

The restraining element can include an o-ring positioned at the outlet portion of the internal chamber.

The restraining element can further include a bypass passage for gas to flow past the lead projectile when the lead projectile is restrained by the o-ring.

The internal chamber of the housing can be shaped to accommodate the series of spherical projectiles as two staggered columns of projectiles.

The internal chamber of the housing can be shaped to position adjacent projectiles at about 60 degrees center-to-center.

The internal chamber of the housing can be shaped to accommodate the series of spherical projectiles as a single column of projectiles.

The internal chamber of the housing can be shaped to accommodate the series of spherical projectiles in at least one region of two staggered columns of projectiles and at least one region of a single column of projectiles.

The internal chamber can follow a serpentine path.

Regions of two staggered columns of projectiles can be located at straight legs of the serpentine path and regions closer to a single column of projectiles can be located at bends having a teardrop shape in the serpentine path. A bend configured to converge a first two staggered column of projectiles into the single column of projectiles and to diverge the single column of projectiles into a second two staggered column of projectiles.

The housing can be configured to be removable from a barrel configured to eject projectiles.

The housing can be shaped as a simulated shotgun shell.

The housing can be integrated into a simulated grenade.

According to another aspect of the present invention, a simulated weapon includes a magazine as discussed above.

According to another aspect of the present invention, a simulated grenade includes a housing defining an internal chamber. The housing further includes a gas inlet situated at an inlet portion of the internal chamber and an outlet situated at an outlet portion of the internal chamber. The internal chamber of the housing is shaped to accommodate a series of spherical projectiles. At least a portion of the internal chamber follows a serpentine path. The simulated grenade further includes a restraining element positioned at the outlet portion of the internal chamber. The restraining element includes a convergence of the internal chamber at the outlet portion. The restraining element is configured to restrain a lead projectile of the series of projectiles against pressure from pressurized gas applied to the gas inlet. The restraining element is configured to release the lead projectile as pressure within the internal chamber rises. The internal chamber terminates at the convergence, which feeds an annular passage at one end of the simulated grenade. The annular passage terminates at an end aligned with the outlet.

A gas cylinder can be disposed in the housing, the gas cylinder for releasing pressurized gas to the gas inlet.

BRIEF DESCRIPTION OF THE DRAWINGS

The drawings illustrate, by way of example only, embodiments of the present disclosure.

DETAILED DESCRIPTION

The present invention aims to solve at least one of the problems discussed above.

Figure 1:
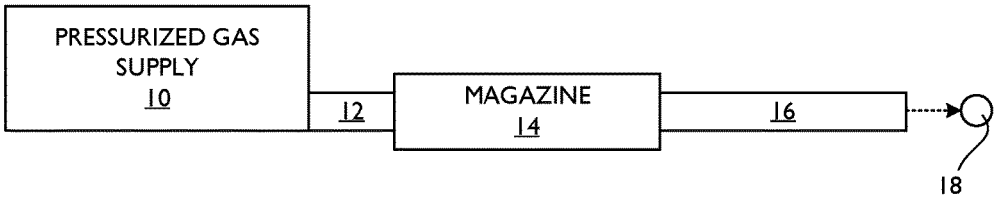
FIG. 1 is a schematic diagram of a simulated weapon.

FIG. 1 shows a simulated weapon, such as the kind used in Airsoft activities, such as games and tactical training. The simulated weapon launches spherical projectiles, such as Airsoft pellets. The simulated weapon includes a pressurised gas supply 10, a triggering mechanism 12, a magazine 14, and a cylindrical barrel 16. The pressurized gas supply 10 can include a canister storing liquid propane, compressed air, compressed carbon-dioxide, or similar. The trigger mechanism 12 can include a mechanical trigger or other kind of gating for releasing pressurized gas into the magazine 14. The magazine 14 provides projectiles 18 to the barrel 16 for launch. These are the general principles of the simulated weapon, although other versions are known. Further, the simulated weapon can represent a shotgun, a grenade, or other type of weapon. The simulated weapon can be a toy weapon, a detailed replica having a high degree of verisimilitude, or similar.

Figure 2:
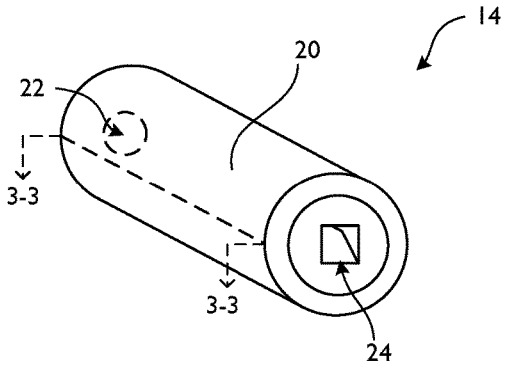
FIG. 2 is a perspective view of a magazine in the form of a simulated shotgun shell.

With reference to FIG. 2, the magazine 14 according to the present invention includes a housing 20 that includes a gas inlet 22 and an outlet 24. The magazine 14 stores a plurality of spherical projectiles, and when pressurized gas is applied to the gas inlet 22, projectiles as well as exhaust gas exit the outlet 24. In the example shown, the housing 20 is shaped as a simulated shotgun shell. The housing 20 can be configured to removable from the barrel 16 to simulate shotgun shell loading and ejection. However, this is not required to simulate shotgun fire, and the housing 20 can be integral to the simulated weapon. Other shapes are also contemplated.

Figure 3:
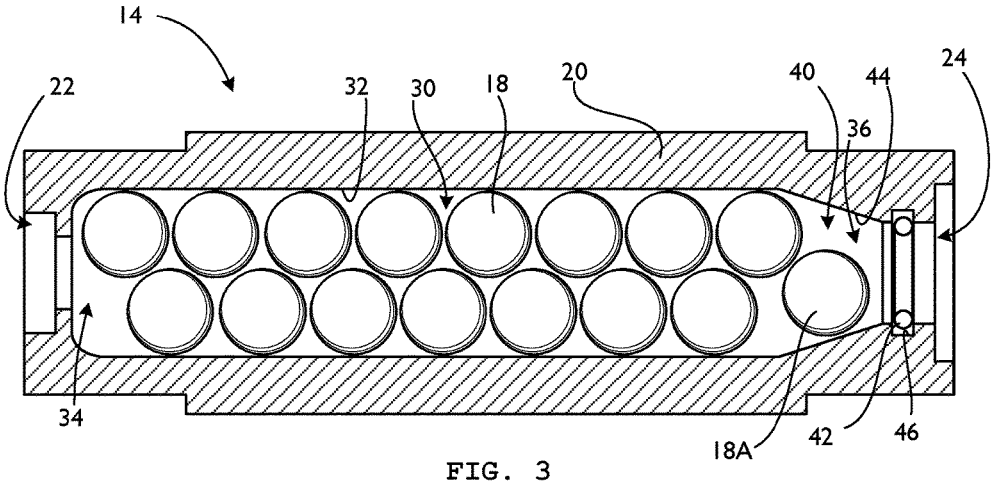
FIG. 3 is a cross-sectional view of the magazine of FIG. 2.

With reference to FIG. 3, housing 20 defines an internal chamber 30 bounded by one or more internal walls 32. The gas inlet 22 is situated at an inlet portion 34 of the internal chamber 30 and the outlet 24 is situated at an outlet portion 36 of the internal chamber 30. The internal chamber 30 is shaped to accommodate a series of spherical projectiles 18. The internal chamber 30 is sized to provide significant clearance around the projectiles 18, so that the projectiles can advance in a controlled manner towards the barrel. In the example shown, the internal chamber 30 is generally rectangular with rounded and sloped corner regions. The cross-section of the internal chamber 30 is generally rectangular. In the example shown, the shape of the internal chamber accommodates two staggered columns of projectiles 18, in which adjacent projectiles at about 60 degrees center-to-center. This can advantageously increase or maximize the storage capacity of the magazine 14. Other shapes of the internal chamber and resulting projectile arrangements are also contemplated.

The magazine further includes a restraining element positioned at the outlet portion 36 of the internal chamber 30. The restraining element is shaped to restrain a lead projectile 18A against pressure from pressurized gas applied to the gas inlet 22. The lead projectile 18A that partially obstructs the outlet 24, and thus while the lead projectile 18A is restrained and pressurized gas remains applied, pressure within the internal chamber 30 rises. The restraining element is also shaped to release the lead projectile 18A as pressure within the internal chamber 30 rises past a certain amount, which is not particularly limited.

The restraining element beneficially regulates flow of projectiles out of the magazine, so that only one projectile tends to be in the barrel 16 at a time. That is, while a projectile being fired is travelling down the barrel 16, the next projectile is restrained by the restraining element while only partially obstructing gas flow and allowing pressure to continue to accelerate (or at least not decelerate) the projectile being fired. Once the projectile being fired leaves the barrel, back pressure in the barrel is reduced causing the next projectile to advance past the restraining element. During this process, the gas pressure advances the remaining queued projectiles behind the next projectile. The restraining element can tend to increase projectile speed and reduce the chance of several projectiles collecting in the barrel and reducing firing velocity or becoming jammed, while still maintaining a high rate of fire. Projectiles are controlled to fire one at a time, rapidly.

In the example shown, the restraining element includes a convergence 40 of the internal chamber 30 and a detent 42, both of which are positioned at the outlet portion 36 of the internal chamber 30 upstream of the outlet 24. The convergence 40 is defines by at least one converging internal wall 44 (e.g., walls arranged as a wedge, cylinder, or similar) and can have an angle of convergence (the angle between the opposite sides of the interior wall 44) of between about 30 degrees and about 40 degrees. More specifically, the convergence 40 can have an angle of convergence of about 35 degrees. The convergence 40, and particularly its cross-section, is shaped to allow gas flow around the lead projectile 18A, but to also provide less cross sectional area around the lead projectile 18A than what is provided around a projectile 18 in the internal chamber 30. In one example, the cross-section of the convergence 40 is rectangular. The convergence advantageously constricts the flow of projectiles, which can increase frictional forces between the lead projectile 18A and the internal wall 44 and other projectiles 18, so as to provide resistance to free flow of projectiles into the barrel. Other shapes for the convergence 40 are also contemplated.

The detent 42 can include a resilient wire loop or ring of rectangle, circular, or other shape that has an unstrained internal dimension that less than an outside diameter of the projectiles 18. The wire can be in the form of a broken metal segment and situated in an internal groove 46 located at the outlet portion 36 of the internal chamber 30. The detent 42 advantageously releasably restrains the lead projectiles 18A, so as to provide resistance to free flow of projectiles into the barrel. Other types of detents, such as static bumps or ribs protruding from the internal wall, are contemplated.

In other examples, only one of the convergence 40 and the detent 42 is used as the restraining element.

In operation, when the propelling gas is vented into the internal chamber 30 through the gas inlet 22, gas flows around the projectiles 18 while imparting a small flow-related force to advance the projectiles 18 towards the restraining element. The lead projectile 18A in the series is pushed into the staging area against the restraining element. The staging area is dimensioned to allow considerable gas flow around the lead projectile 18A, but to also provide less cross sectional area around the lead projectile 18A than what is provided in the internal chamber 30. This causes a higher pressure drop over the lead projectile 18A.

If the barrel is not occupied by a projectile, the barrel acts as a large bore opening with little restriction. This results in a low pressure region downstream of the restraining element and makes the lead projectile 18A the dominant restriction. The high pressure drop across the lead projectile 18A results in a high net force which overcomes the restraining element allowing the pellet to pass the restraining element and enter the barrel where it is accelerated rapidly. Because the projectile fits the walls of the barrel closely, and the projectile has considerable mass, the projectile in the barrel becomes the dominant flow restriction which reduces the pressure drop across the subsequent lead projectile 18A.

Once the projectile travelling down the barrel leaves the barrel, barrel pressure drops rapidly which places a low pressure region in front of the subsequent lead projectile 18A. The cycle is repeated until all projectiles are fired or until gas pressure is removed.

Figure 4A:
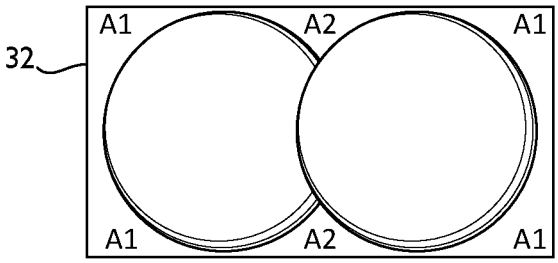
FIGS. 4A 4C are schematic diagrams of end-on cross-sections of the magazine.
Figure 4B:
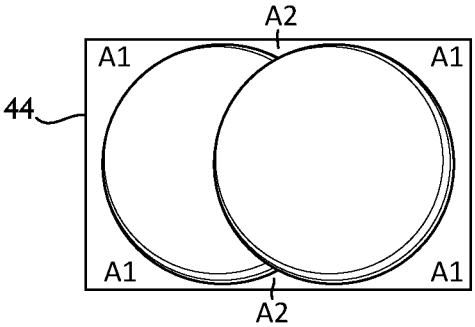
Figure 4C:
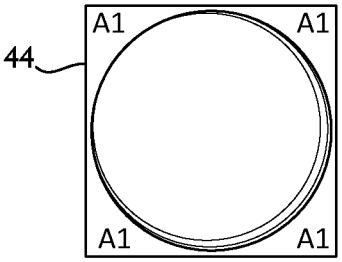

FIGS. 4A 4C show the internal chamber 30 and convergence 40 in schematic cross section. FIG. 4A depicts the internal chamber 30 with four cross-sectional areas A1 and two cross-sectional areas A2 forming gaps between the projectiles and the internal walls 32 of the internal chamber 30. When considering projectiles in the convergence 40 as bounded by the converging internal walls 44, the cross-sectional areas A2 are reduced with respect to FIG. 4A. As the convergence 40 narrows to the smallest size, the cross-sectional areas A2 reduce until one projectile obstructs the convergence 40, leaving the cross-sectional areas A1 for gas flow. As is evident, the total cross-sectional area (4*A1+2*A2) available for flow of gas reduces from the internal chamber 30 and through to the smallest part of the convergence 40, thereby increasing the pressure acting on the lead projectile.

Figure 5:
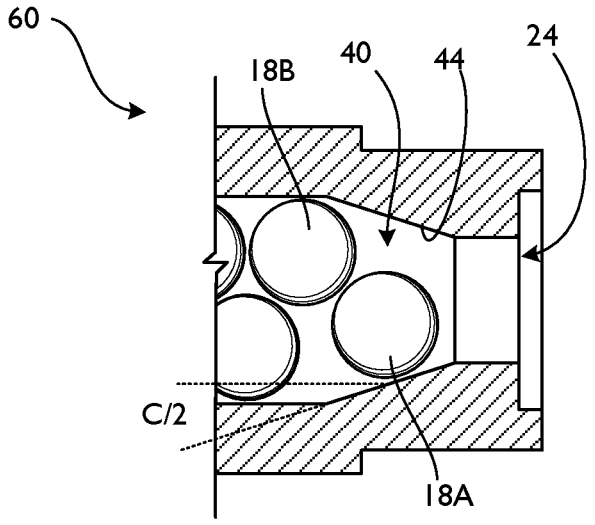
FIG. 5 is a partial cross section of a magazine with no detent.

FIG. 5 shows an embodiment of a magazine 60 in which the convergence 40 is used and the detent and its groove are omitted. Features and aspects of the other embodiments discussed herein can be applied to the magazine 60 and like numerals denote like parts. As pressure acts on the projectiles, the lead projectile 18A is somewhat wedged or jammed against the internal wall 44 of the convergence 40 and the immediately following projectile 18B, so as to resist free flow out of the outlet 24. Also shown in this figure is half the convergence angle C. Further, although the convergence 40 is symmetric, it need not be.

Figure 6:
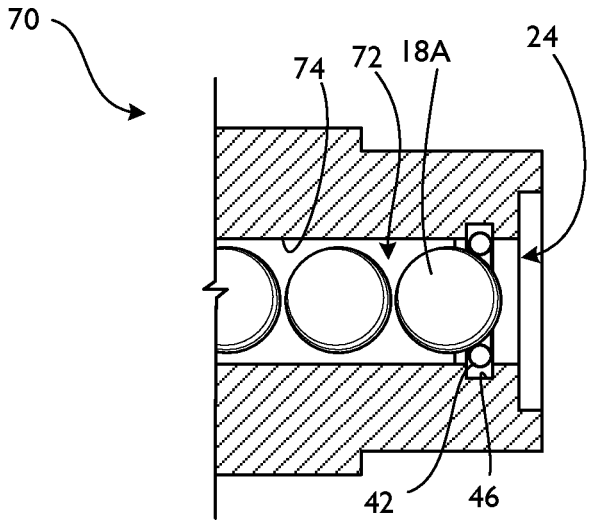
FIG. 6 is a partial cross section of a magazine with no convergence.

FIG. 6 shows an embodiment of a magazine 70 in which the detent wire 42 and its groove 46 are used and the convergence is omitted. The internal chamber 72 is generally uniform in shape approaching the outlet 24, so as to guide the projectiles in a single column. The lead projectile 18A is restrained by the detent wire 42, while gas may be permitted to flow past the column of projectiles and flow past the lead projectile 18A by way of gaps between the projectiles and an inner wall of the internal chamber 72 and gaps between the detent wire 42 and its groove 46. Once the net force acting on the lead projectile 18A, from one or both of direct pressure and contact with the adjacent projectile, the lead projectile 18A opens the resilient detent wire 42 enough to pass through the detent wire 42 and leave the outlet 24. The resilient detent wire 42 immediately returns to its unstrained dimension to restrain the next projectile. The magazine 70 can be used in a simulated weapon that loads from a bulk spring-loaded magazine to provide a simulated shotgun that does not require ejection of shells. Features and aspects of the other embodiments discussed herein can be applied to the magazine 70 and like numerals denote like parts.

The fast and controlled output of projectiles permitted by the techniques of the present invention advantageously allows a shotgun shot to be simulated by a rapid burst of projectiles. A stream of projectiles is launched at a high rate of fire, so as to be perceived as a single blast through a single barrel, while maintaining controlled flow of projectiles.

Figure 7:
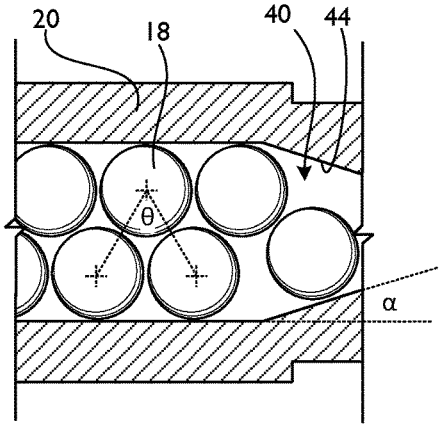
FIG. 7 is a partial cross section of a magazine shown a stack configuration.

FIG. 7 shows the relationship between the stacking configuration of the projectiles 18 in the magazine with the angle of the walls 44 in the convergence 40. In the embodiment show, the angle θ (also known as the pellet angle) is the angle between the centers of the projectiles 18. The angle θ can be varied depending on the dimension of the magazine. For example, as the interior dimensions of the magazine narrow, the angle θ would increase as the projectiles 18 cannot be stacked as tightly along the axial direction of the magazine. The angle α is the angle of the interior wall 44 to the axis of the magazine in the convergence 40. In the present embodiment, the angle α is generally designed to be less than or equal to about half of the angle θ to reduce the likelihood of binding or perpendicular impingement of the projectiles 18. However, it is to be appreciated that in other embodiments with different dimensions to address binding, the angles α and θ can be varied.

Figure 8A:
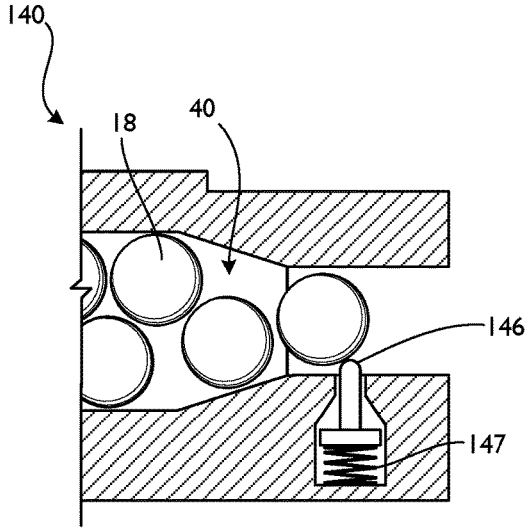
FIG. 8A is a partial cross section of a magazine in accordance with another embodiment.
Figure 8B:
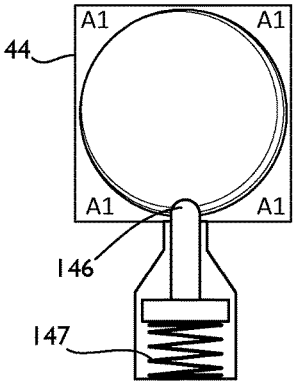
FIG. 8B is a schematic diagram of an end-on cross-section of the magazine of FIG. 8A.

FIGS. 8A and 8B show an embodiment of a magazine 140 with another restraining element. In the present embodiment, the restraining element includes the convergence 40, a detent 146 and a biasing member 147, such as a spring. The biasing member 147 is generally configured to urge the detent 146 into the convergence to provide resistance to the projectiles. As shown in FIG. 8B, four cross-sectional areas A1 forms gaps to provide gas flow to the barrel.

Figure 9:
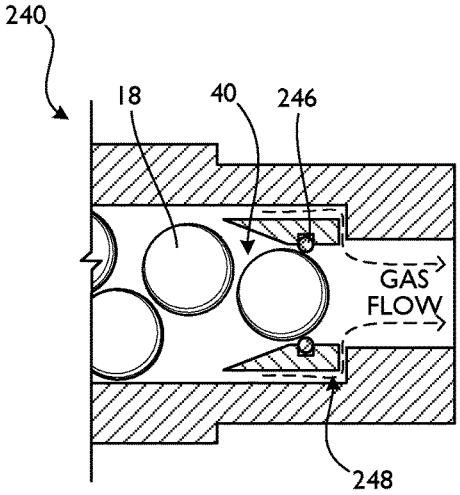
FIG. 9 is a partial cross section of a magazine in accordance with yet another embodiment.

FIG. 9 shows an embodiment of a magazine 240 with another restraining element. In the present embodiment, the restraining element includes the convergence 40, an o-ring 246 and a bypass passage 248 for gas to flow past a projectile restrained by the o-ring 246 and into the barrel. The o-ring 246 restrains the lead projectile until pressure build up is sufficient to eject it. The bypass passage 248 provides continual gas flow to continue to propel ejected projectiles and reduce the chance of several projectiles collecting in the barrel.

Figure 10:
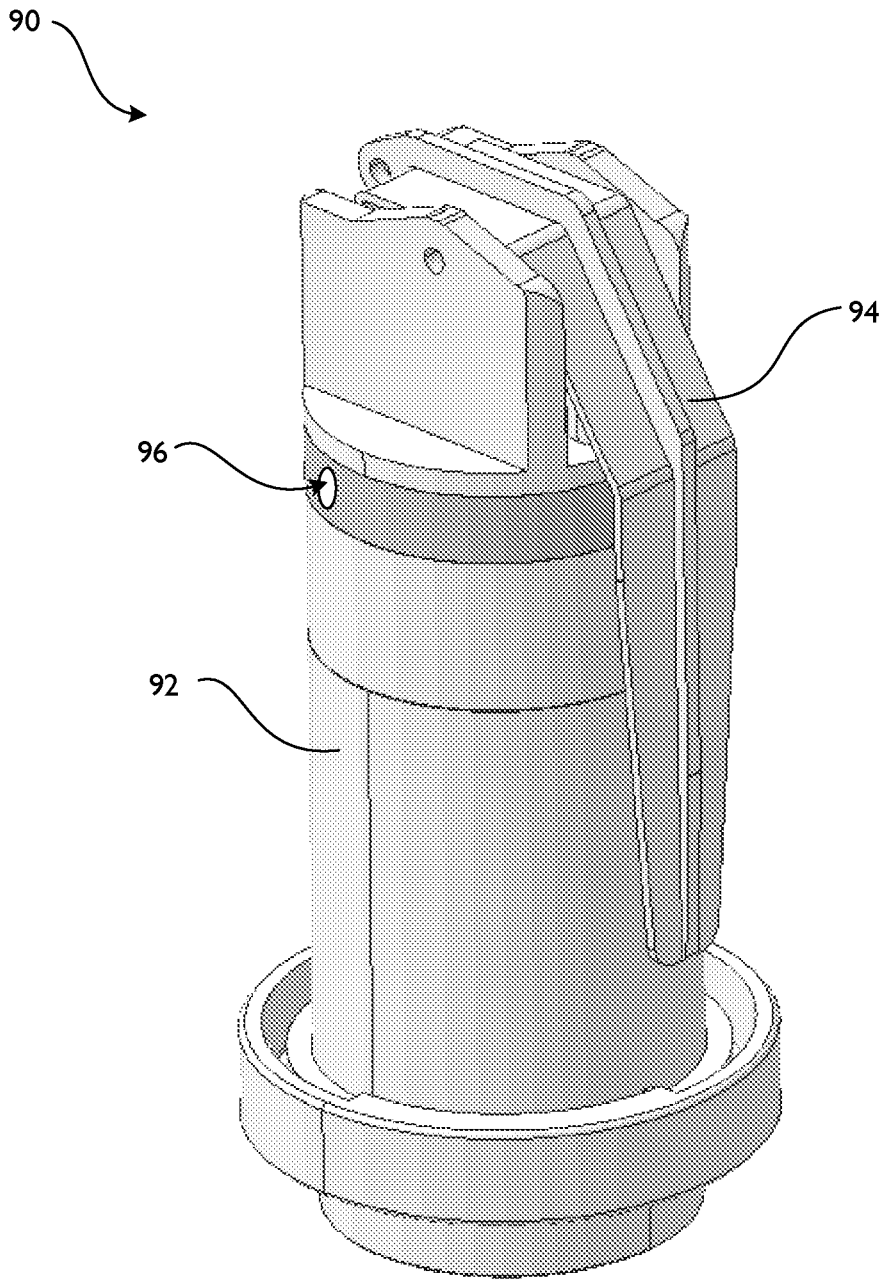
FIG. 10 is a perspective view of simulated grenade.

FIG. 10 shows a perspective view of a simulated weapon in the form of a grenade 90 according to the present invention. Features and aspects of the other embodiments discussed herein can be applied to the simulated grenade 90. The grenade 90 includes a cylindrical cover 92 for containing projectiles and an activation lever 94 for triggering ejection of the projectiles through an outlet 96 by way of gas pressure.

Figure 11:
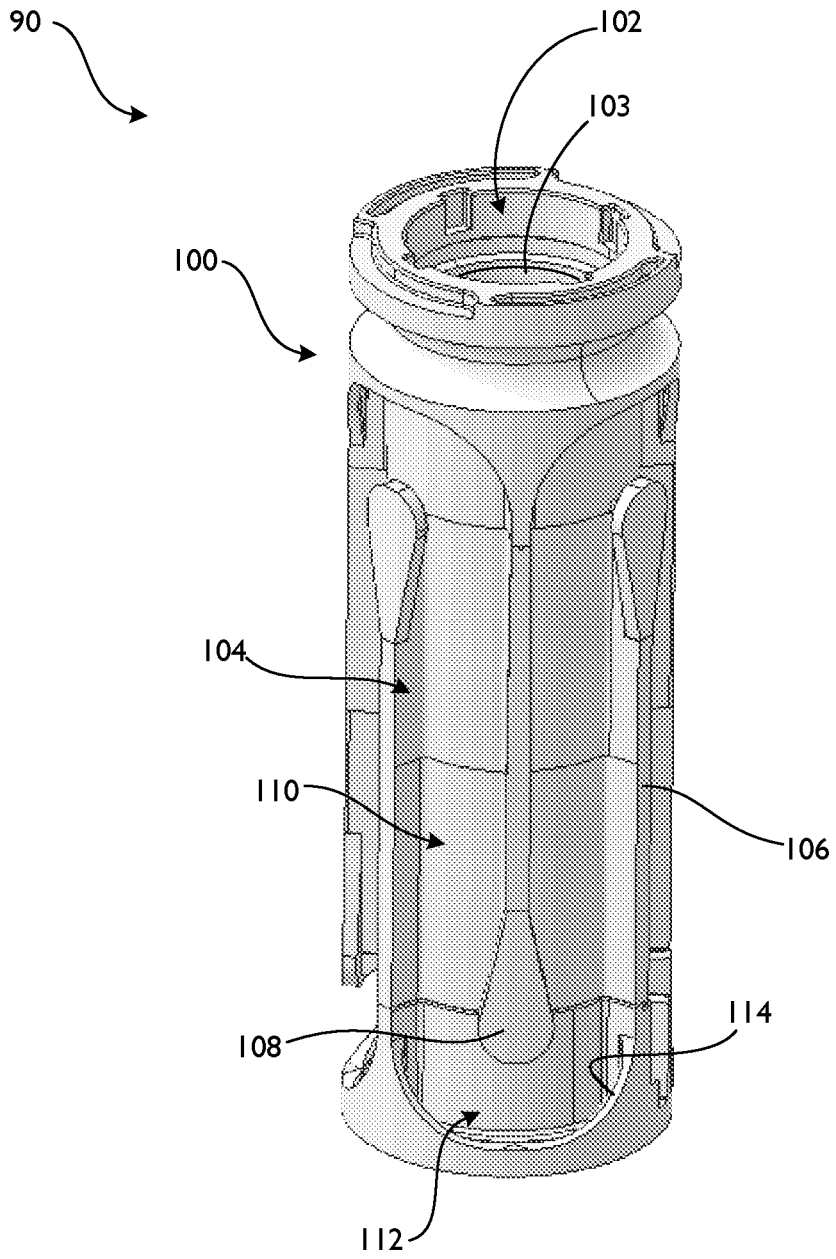
FIG. 11 is a perspective view of internal structure of the simulated grenade.

FIG. 11 shows the simulated grenade 90 with the cover 92 removed. The grenade 90 includes a hollow, cylindrical internal housing 100 having a central opening 102 for receiving a pressurized gas cylinder 103 that is triggered to release pressurized gas in response to actuation of the lever 94 (FIG. 10) with intermediation of a timing mechanism or trigger mechanism (not shown). The housing 100 and cover 92 cooperate to form a projectile magazine. Pressurised gas is released into an internal chamber 104 of the magazine through a gas inlet (not shown) extending through the wall of the housing 100.

The internal chamber 104 is defined by a channel in the outside surface of the housing 100 and the cover 92. The internal chamber 104 is shaped to accommodate a series of spherical projectiles. The internal chamber 104 follows a serpentine path having straight legs running the length of the housing 100 and U-bends at ends of the straight legs. Straight legs are isolated from one another by walls 106 and U-bends are defined by convexly curves ends 108 of such walls 106. The convexly curves ends 108 can be teardrop shaped or similar shape. The shape of the serpentine path can advantageously increase a number of projectiles that may be launched. The serpentine path is an example of a convoluted path that is wrapped around the outside of the cylindrical housing 100. Other paths are also contemplated.

Straight regions 110 of the legs can be shaped to store two staggered columns of projectiles (see FIG. 3). Curved regions 112 of the bends can be shaped to converge the two staggered columns into a closer, more linear arrangement of projectiles and then diverge the closer arrangement back to the two staggered arrangement. An example of a suitable closer, more linear arrangement is a single column of projectiles, such as that shown in FIG. 6, which follows the bend. Such a single column of projectiles need not be exactly linear and is contemplated to include arrangements with projectile center-to-center angles of less than 60 degrees. The bends providing for a narrower arrangement of projectiles advantageously helps rapid flow of projectiles around the bends while reducing the chance that projectiles become stuck in the bends. In other examples, inwardly facing convex regions are provided at the outside wall 114 of the bends instead of or in addition to the convexly curves ends 108.

Figure 12:
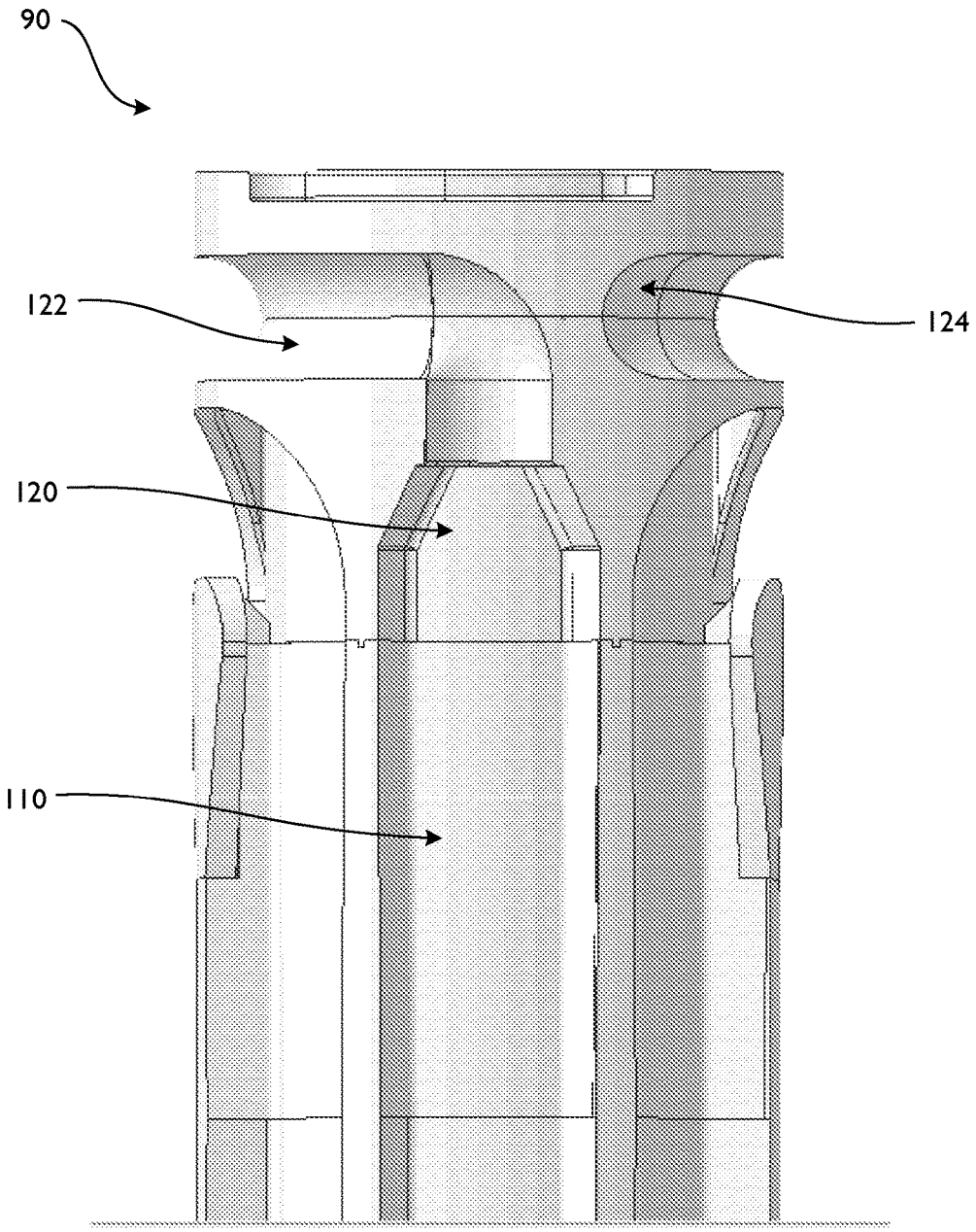
FIG. 12 is a partial perspective view of further internal structure of the simulated grenade.

As shown in FIG. 12, the serpentine internal chamber 104 terminates at a convergence 120 (see FIG. 3) that feeds an annular passage 122 at one end of the grenade 90. The annular passage 122 terminates at an end 124 aligned with the outlet 96 (FIG. 10) in the cover 92.

The fast and controlled output of projectiles permitted by the techniques of the present invention advantageously allows a grenade to be simulated by a rapid burst of projectiles. A stream of projectiles is launched at a high rate of fire, so as to be perceived as a single blast. Moreover, dynamic reactions from the stream of projectiles impart forces on the grenade to cause the grenade to move chaotically to output a blast-like cloud of projectiles.

While the foregoing provides certain non-limiting example embodiments, it should be understood that combinations, subsets, and variations of the foregoing are contemplated. The monopoly sought is defined by the claims.

What is claimed is:

1. A magazine for projectiles in a simulated weapon, the magazine comprising:

a housing defining an internal chamber, the housing further including a gas inlet situated at an inlet portion of the internal chamber and an outlet situated at an outlet portion of the internal chamber, the internal chamber of the housing shaped to accommodate a series of projectiles; and a restraining element positioned at the outlet portion of the internal chamber, the restraining element configured to restrain a leading projectile of the series of projectiles against pressure from pressurized gas applied to the gas inlet, the restraining element configured to release the leading projectile as pressure across the leading projectile rises;

a bypass passage for gas to flow past the leading projectile when the leading projectile is restrained by the restraining element.

2. The magazine of claim 1, wherein the restraining element comprises a convergence of the internal chamber at the outlet portion.

3. The magazine of claim 2, wherein the convergence has an angle of convergence of less than about half of a pellet angle.

4. The magazine of claim 3, wherein the restraining element comprises a detent positioned at the outlet portion of the internal chamber.

5. The magazine of claim 4, wherein the detent comprises a ring that has an unstrained internal dimension that less than an outside diameter of the projectile.

6. The magazine of claim 4, wherein the detent is spring-loaded.

7. The magazine of claim 3, wherein the restraining element comprises an o-ring positioned at the outlet portion of the internal chamber.

8. The magazine of claim 1, wherein the internal chamber of the housing is shaped to accommodate the series of projectiles as two staggered columns of projectiles.

9. The magazine of claim 8, wherein the internal chamber of the housing is shaped to position adjacent projectiles at about 60 degrees center-to-center.

10. The magazine of claim 1, wherein the internal chamber of the housing is shaped to accommodate the series of projectiles as a single column of projectiles.

11. The magazine of claim 1, wherein the internal chamber of the housing is shaped to accommodate the series of projectiles in at least one region of two staggered columns of projectiles and at least one region of a single column of projectiles.

12. The magazine of claim 11, wherein the internal chamber follows a serpentine path.

13. The magazine of claim 12, wherein regions of two staggered columns of projectiles are located at straight legs of the serpentine path and regions closer to a single column of projectiles are located at bends having a teardrop shape in the serpentine path, a bend configured to converge a first two staggered column of projectiles into the single column of projectiles and to diverge the single column of projectiles into a second two staggered column of projectiles.

14. The magazine of claim 13, wherein the housing is configured to be removable from a barrel configured to eject projectiles.

15. The magazine of claim 14, wherein the housing is shaped as a simulated shotgun shell.

16. The magazine of claim 14, wherein the housing is integrated into a simulated grenade.

17. A simulated weapon comprising the magazine of claim 1.

18. A simulated grenade comprising:

a housing defining an internal chamber, the housing further including a gas inlet situated at an inlet portion of the internal chamber and an outlet situated at an outlet portion of the internal chamber, the internal chamber of the housing shaped to accommodate a series of projectiles, at least a portion of the internal chamber following a serpentine path; and a restraining element positioned at the outlet portion of the internal chamber, the restraining element including a convergence of the internal chamber at the outlet portion, the restraining element configured to restrain a leading projectile of the series of projectiles against pressure from pressurized gas applied to the gas inlet, the restraining element configured to release the leading projectile as pressure across the leading projectile rises;

the internal chamber terminating at the convergence, which feeds an annular passage at one end of the simulated grenade, the annular passage terminating at an end aligned with the outlet;

a bypass passage for gas to flow past the leading projectile when the leading projectile is restrained by the restraining element.

19. The simulated grenade of claim 18, further comprising a gas cylinder disposed in the housing, the gas cylinder for releasing pressurized gas to the gas inlet.

* * * * *